US005156103A

United States Patent [19]

Buschmann et al.

[11] Patent Number: 5,156,103

[45] Date of Patent: Oct. 20, 1992

[54] LOOPER-THREAD FEED DEVICE FOR AN EYELET BUTTONHOLE SEWING MACHINE

[75] Inventors: Karl-Heinz Buschmann; Eberhard Kastrup, both of Bielefeld, Fed. Rep. of Germany

[73] Assignee: Dürkopp Adler Aktiengesellschaft, Fed. Rep. of Germany

[21] Appl. No.: 860,164

[22] Filed: Mar. 30, 1992

[30] Foreign Application Priority Data

Apr. 3, 1991 [DE] Fed. Rep. of Germany ..... 4110684

[51] Int. Cl.[5] ..... D05B 3/08

[52] U.S. Cl. ..... 112/66; 112/68; 112/253; 112/DIG. 1

[58] Field of Search ..... 112/66, 65, 68, 69, 112/285, 287, 253, DIG. 1

[56] References Cited

U.S. PATENT DOCUMENTS 3,254,616 6/1966 Pudelko ..... 112/65
3,273,523 9/1966 Pudelko ..... 112/253
4,038,933 8/1977 Marforio ..... 112/253 X
4,228,748 10/1980 Dufault ..... 112/65

*Primary Examiner*—Peter Nerbun
*Attorney, Agent, or Firm*—Ostrolenk, Faber, Gerb & Soffen

[57] ABSTRACT

An eyelet buttonhole sewing machine has a suction device between the throat plate and the wedge-shaped knife of the buttonhole cutting device. The suction device includes a suction tube and is connected to a vacuum generator, for instance an ejector nozzle or a transvector nozzle. The looper thread is brought near the suction device by a thread puller. When the looper thread is cut by the thread cutting device at the end of the sewing process, suction is applied to the suction tube, pulling the end of the looper thread into the opening of the suction tube. In this way, the looper-thread end assumes a well defined position in which it is disposed for being completely covered by the corresponding welt of the following buttonhole to be sewn. With the suction device and thread puller operating as described, it is no longer necessary to clean the buttonhole by cutting off the end of the looper thread.

12 Claims, 6 Drawing Sheets

LOOPER-THREAD FEED DEVICE FOR AN EYELET BUTTONHOLE SEWING MACHINE

BACKGROUND OF THE INVENTION

1. Field of the Invention

The present invention relates to a looper-thread feed device. It relates more particularly to a looper-thread feeding device for feeding a looper thread in an eyelet buttonhole sewing machine, the sewing machine comprising a turnable looper pedestal, a thread cutting device for cutting the looper thread, and a buttonhole cutting device; a throat plate and a thread tensioning device which tensions the looper thread being provided on the looper pedestal.

2. Description of Related Art

A looper-thread feed device of background interest is known from German Patent 11 75 535 (contained in U.S. Pat. No. 3,254,616). This known looper-thread feed device consists essentially of a throat plate which is fastened on a turnable looper pedestal of an eyelet buttonhole machine and provided with a thread clamp, the throat plate containing a narrow guide slot. The slot debouches into a needle hole contained in the throat plate, the guide slot undercutting a region of the throat plate which adjoins the needle hole. By the special arrangement of the guide slot in the throat plate, the result is obtained that the cut end of the looper thread, which has been severed by a thread cutting device after completion of a given sewing step, is guided, upon the return movement of the throat plate into the starting position for the next sewing step, into the stitch-forming region of the needle hole. In this way, in the next sewing step, the result is obtained that the end of the looper thread, fed in the manner described above, is sewn into the buttonhole welt of the buttonhole in question, as a result of which subsequent cutting of the end of the otherwise protruding looper thread is dispensed with.

A disadvantage of the known looper-thread feed device is that the throat plate, which is undercut in part by the guide slot, has a considerable reduction in cross section in the region in question so that the throat plate may be broken if struck by the sewing needle.

SUMMARY OF THE INVENTION

The main object of the present invention is therefore to develop a looper-thread feed device of this type that can reliably feed the cut end of the looper thread to the throat plate without additional work.

This object may be achieved by a looper-thread feed device, for example, which comprises a suction device for engaging and securing the cut end of the looper thread, vacuum coupling means for functionally connecting the suction device with a vacuum generator, and thread puller means for pulling the looper thread end into engagement with the suction device.

With respect to the suction device in the invention, which is connected to a source of vacuum, it is furthermore pointed out that it is already known from the prior art (Federal Republic of Germany Utility Model 81 16 087) to provide a thread clamping device on the sewing-machine head for holding the free end of the needle thread between two sewing processes, the clamping device consisting of a suction tube arranged above the place of sewing and functionally connected with a source of vacuum and a clamping element arranged therein.

With the looper-thread feed device of the invention, the result is advantageously obtained that the end of the looper thread that is cut upon the completion of the sewing process assumes a taut position which is well-defined with reference to the first welt of the next buttonhole to be sewn.

Advantageously, the suction device is provided between the buttonhole cutting device and the throat plate and includes a suction tube which is in communication with said vacuum coupling means.

The vacuum generator may include either an ejector nozzle or a transvector nozzle, for example, connected to the suction device via the vacuum coupling means. In the preferred embodiment of the invention, the vacuum generator is connected to an external source of compressed air via either an electromagnetically actuatable 3/2-way valve, or a roller-actuatable 3/2-way valve which is controlled by cam means.

In the preferred embodiment, the thread pulling means comprises a support bar rigidly secured to the looper pedestal and a thread pulling lever which is swingable around a pivot on the support bar, the thread pulling lever having an inactive position, defined by a stop, wherein a thread guide hole on the thread pulling lever for guiding said looper thread is aligned with lower guide means on the looper pedestal for guiding the looper thread. A spring may be provided for urging said thread pulling lever into said inactive position. The thread pulling lever also has an active position and said thread pulling lever moves toward said active position while pulling the looper thread toward the suction device. A piston rod of a compressed air cylinder on the sewing machine presses momentarily against an extension on the thread pulling lever, as a result of which the thread pulling lever carries out a swinging movement through an angle from its inactive position to its active position. The sewing machine has means for adjusting the angle of the swinging movement.

BRIEF DESCRIPTION OF THE DRAWINGS

One embodiment of the invention will be explained with reference to FIGS. 1 to 6, in which.

DETAILED DESCRIPTION OF AN EMBODIMENT OF THE INVENTION

Figure 1:
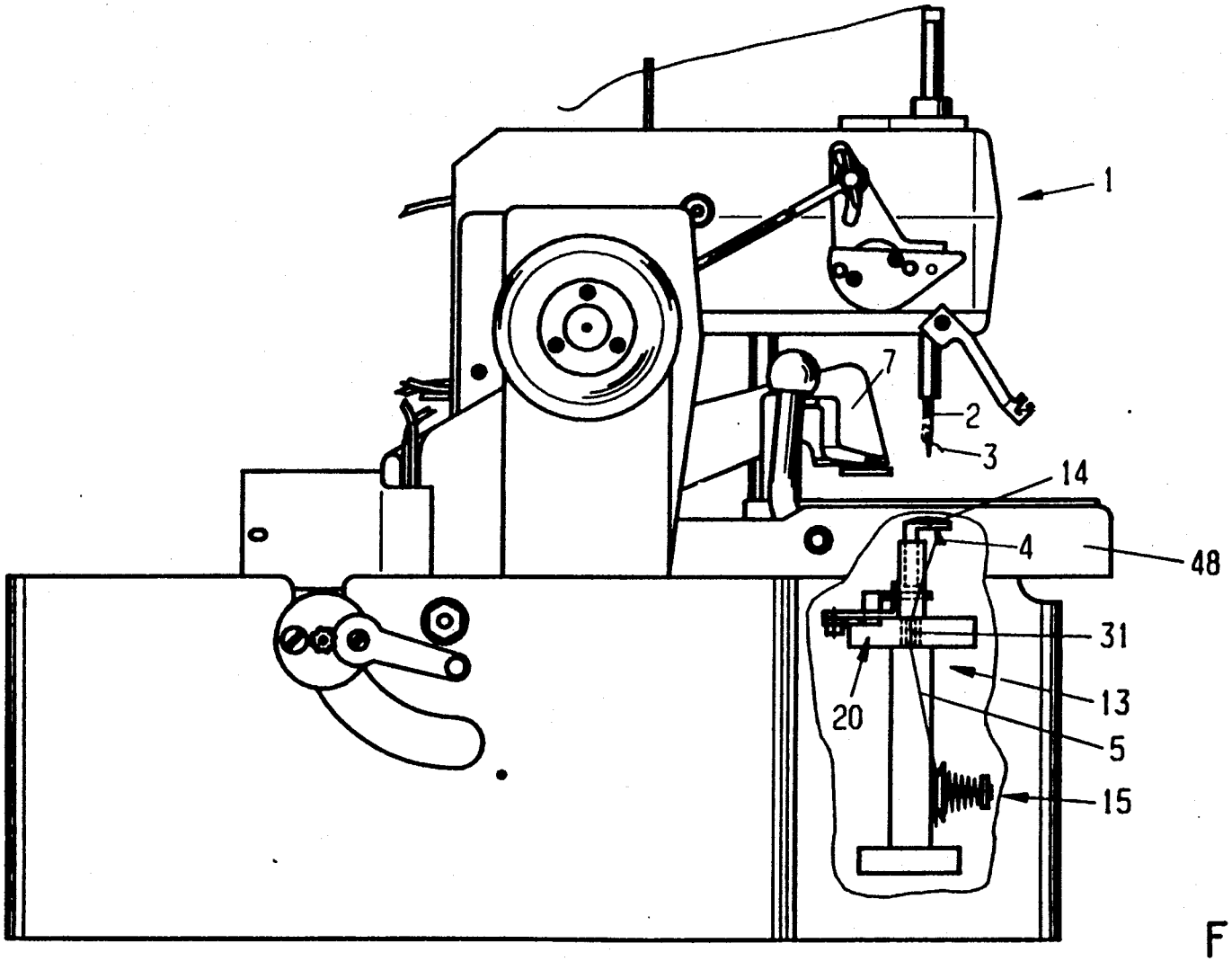
FIG. 1 is a simplified side view of an eyelet buttonhole sewing machine.
Figure 6:
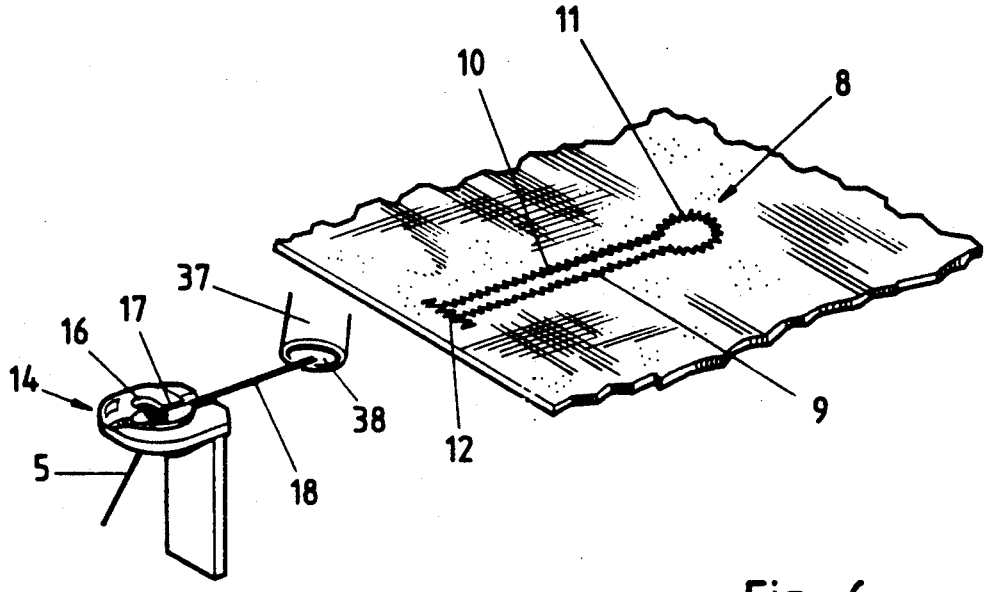
FIG. 6 is a simplified showing of a completely sewn buttonhole, the cut end of the looper thread extending into the suction tube.

Referring to FIG. 1, the eyelet buttonhole sewing machine 1 shown, which is of traditional construction, is equipped with a sewing needle 2 which guides the sewing thread 3, and with a looper 4 which guides the looper thread 5. The eyelet buttonhole sewing machine is furthermore equipped with a thread cutting device 6 (FIG. 2) for cutting the looper thread 5 after completion of a sewing step and with a buttonhole cutting device 7 for cutting open the buttonhole 8. The latter, as is known, includes a right hand welt 9, a left hand welt 10, an eyelet 11 and a closure bar 12 (FIG. 6).

Figure 2:
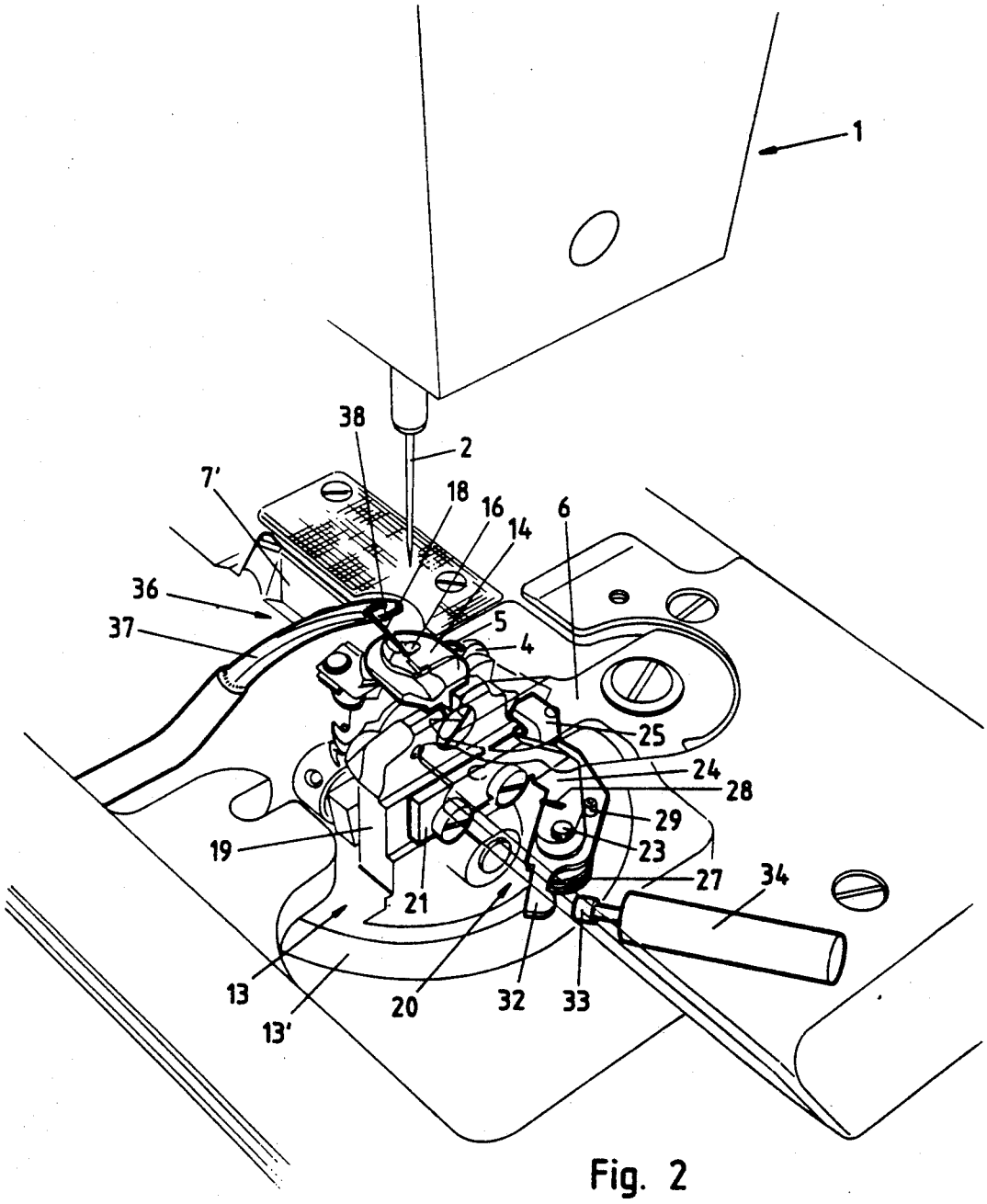
FIG. 2 is a perspective view of the stitch-forming region of the eyelet buttonhole sewing machine.

Part of the eyelet buttonhole sewing machine 1 is a turnable looper pedestal 13, known per se, which is mounted in an eye 13' provided on the machine frame (see FIG. 2). A throat plate 14 and a thread tensioning device 15 which acts on the looper thread 5 are fastened on the looper pedestal 13. The throat plate 14 has a needle hole 16 and a slot 17 (FIGS. 2, 6). The slot aligns a looper-thread end 18 emerging from the needle hole 16 in correct position.

The main part of the turnable looper pedestal 13 is a support member 19 on which the aforementioned throat plate 14 and thread tensioning device 15 are fastened in known manner. Furthermore, the support member 19 also carries a thread puller 20 (FIGS. 2, 5) which is thus arranged on the looper pedestal 13 and thus also participates in the turning movement of the looper pedestal 13.

Figure 5:
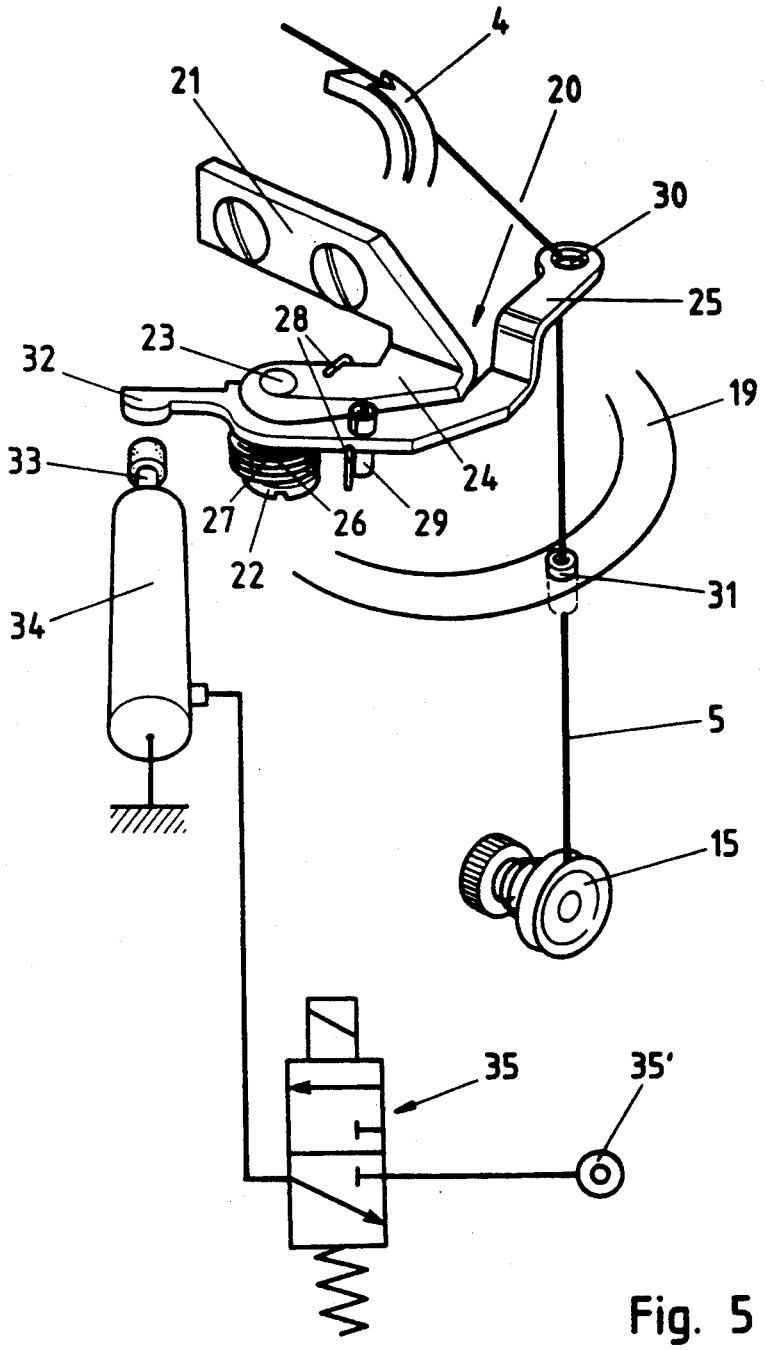
FIG. 5 is a simplified perspective diagram of the thread-pull lever which is fastened on the turnable looper pedestal, shown in its inactive position.

As shown in FIG. 5, the thread puller 20 includes an angle 21 which is fastened to the support member 19 (see FIG. 2) and is thus also firmly attached to the looper pedestal 13. A shoulder screw 22 is fastened in formedlocked manner via its threaded shank 23 to one arm 24 of the angle 21. A thread pulling lever 25 is swingably mounted on the shoulder screw 22, a bearing bushing 26 being connected firmly to the thread pulling lever 25 for guiding the latter.

The thread pulling lever 25 is swingably mounted between the head of the shoulder screw 22 and the arm 24. Over the bearing bushing 26 there is placed a torsion spring 27 having two arm ends 28 which act on corresponding points on the arm 24 and the thread pulling lever 25 respectively, as shown in FIG. 5. A stop pin 29 is forcefitted in the thread pulling lever 25, the pin, together with the torsion spring 27, establishing an inactive position of the thread pulling lever 25.

Figure 3:
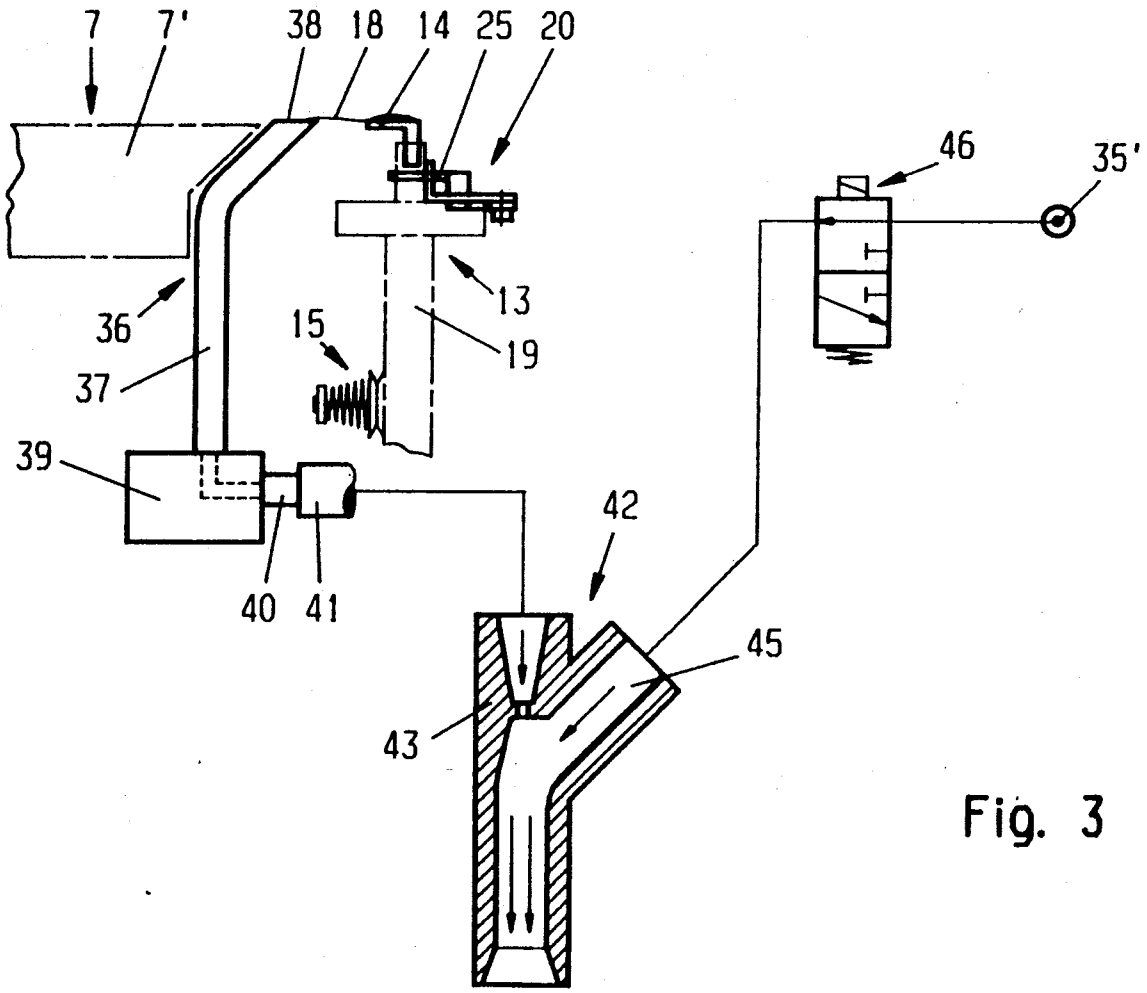
FIG. 3 is a simplified basic diagram of a suction device connected to an ejector nozzle.

On the free end of the thread pulling lever 25 there is a thread guide hole 30 which, in the inactive position of the thread pulling lever 25, is aligned above a thread guide tube 31. As shown in FIGS. 3 and 5, the thread guide tube 31 is force-fitted in the support member 19 in such a position that, in the inactive position of the thread pulling lever 25, the thread guide hole 30 and the thread guide tube 31 are in alignment with the course of the looper thread 5. After it has left the thread guide hole 30, the looper thread 5 is conducted to the thread guiding looper 4 (see FIG. 5) which is mounted in the looper pedestal 13.

As shown in FIGS. 2 and 5, an extension 32 is provided on the thread pulling lever 25. An extractable piston rod 33 of a setting member mounted fixed on the frame, for instance a compressed air cylinder 34 or an electromagnet, momentarily presses on the extension 32. The compressed air cylinder 34 can be acted on by compressed air via an ordinary commercial 3/2-way valve 35 which is supplied from an external source of compress air 35'.

The aforementioned thread cutting device 6 as well as the buttonhole cutting device 7, which as is known includes a wedge-shaped knife 7', are well known parts of an eyelet buttonhole sewing machine, so that a description of their construction and function can be dispensed with here. The same is true of the turnable looper pedestal 13, which is also known, and the thread tensioning device 15 provided on it.

Figure 4:
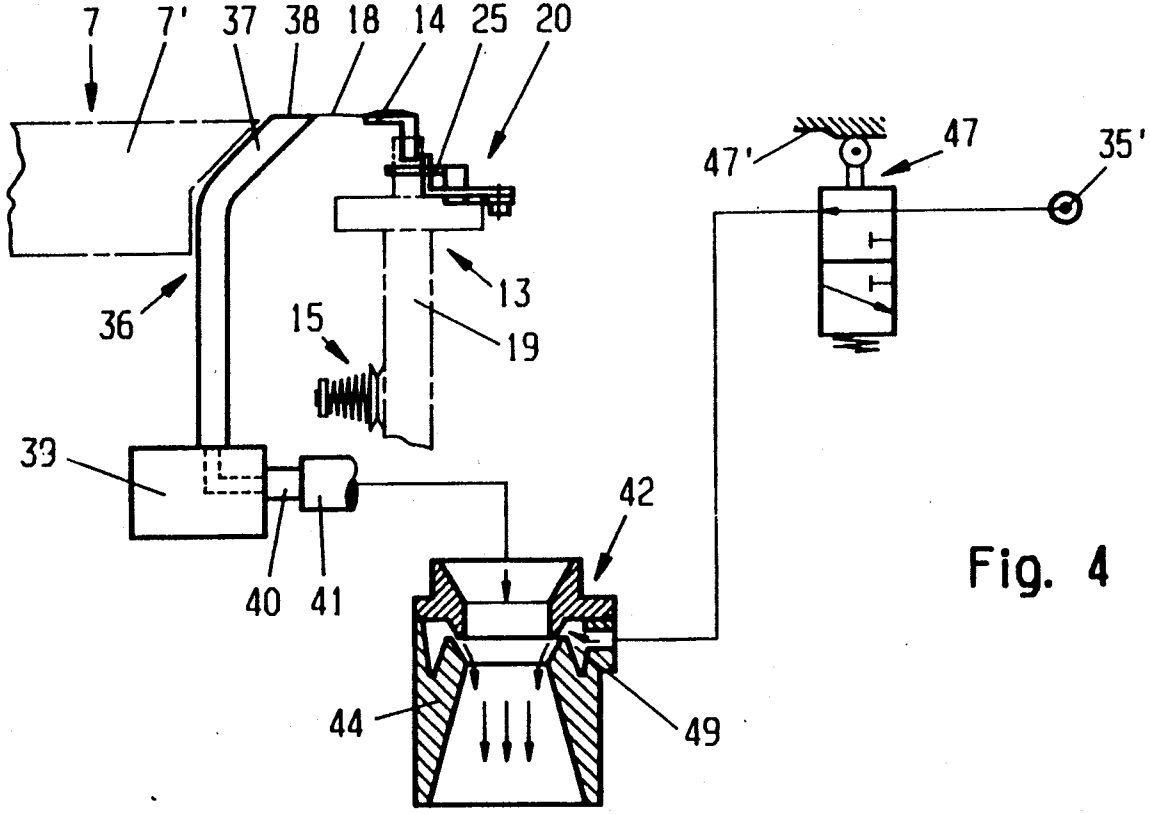
FIG. 4 is a simplified basic diagram of a suction device connected to a transvector nozzle.

As shown in FIG. 2, a suction device 36 is provided between the wedge-type knife of the buttonhole sewing device 7 and the throat plate 14. The suction device includes a suction tube 37 which is bent at an angle in its upper region, as shown in FIGS. 3 and 4, so that the suction tube 37 adapts itself to the shape of the knife 7'. In this way, an opening 38 of the suction tube 37 is directly in front of the knife 7' of the buttonhole cutting device 7 (see FIGS. 2 to 4). The lower end of the suction tube 37 is connected to a block 39 which is mounted in the eyelet buttonhole sewing machine 1 at a suitable place, fixed on the frame. On the block 39 there is furthermore provided an outlet socket 40. From the latter, a hose 41 extends to a vacuum generator 42 which is formed of an ejector nozzle 43 in accordance with FIG. 3 or by a transvector nozzle 44 in accordance with FIG. 4.

In accordance with FIG. 3, compressed air is fed into an inlet socket 45 of the ejector nozzle 43 via another electromagnetically actuatable 3/2-way valve 46. As shown in FIG. 4, compressed air is fed into the inlet socket 49 of the transvector nozzle 44 via a roller-actuatable 3/2-way valve 47. The compressed air fed into the ejector nozzle 43 or transvector nozzle 44 is taken from the external source of compressed air 35'.

The proper actuation of the compressed air cylinder 34 and of the ejector nozzle 43 or transvector nozzle 44 with respect to the start and duration of the sewing process to be carried out is effected by a control (not shown here), which is part of the eyelet buttonhole sewing machine as delivered.

The manner of operation of the looper-thread feed device of the invention will now be described.

After completion of the sewing of a buttonhole 8, and therefore after the terminating bar 12, if any, has been sewn, the looper thread 5 extends from the bottom of the buttonhole 8 through the needle hole 16 to the thread conducting looper 4 and from there further to the thread guide tube 31 and the thread tensioning device 15. In this way, the looper thread 5 remains at all times under a certain tension on its path through the needle hole 16 up to the buttonhole 8.

After the automatic cycle of the eyelet buttonhole sewing machine 1 is completed, a fabric support plate 48 forming part of the machine which is known per se, is moved back from the sewing position into its initial starting position. In this connection, simultaneously, the looper pedestal 13 and the throat plate 14 fastened to it turn back counterclockwise. Toward the end of that turning-back movement of the looper pedestal, the looper thread 5 which has emerged from the needle hole 16 passes into the slot 17, so that it is in the immediate vicinity of the stitch-forming point.

At the end of the aforementioned backward turning of the looper pedestal 13, the thread puller 20 on the looper pedestal 13 has assumed such a position that the extension 32 on the thread pulling lever 25 is in the immediate vicinity of the piston rod 33. The compressed air cylinder 34 is now acted on by compressed air via the 3/2-way valve 35. The dome of the piston rod 33 moves out and thereby strikes against the extension 32 and swings it, as well as the thread pulling lever 25, in the counterclockwise direction. In this way, a well-defined amount of thread is pulled out of the thread tensioning device 15. The amount of thread which is pulled out in this step can be controlled by the size of the angle of swing carried out by the thread pulling lever 25. Although the compressed air cylinder 34 is arranged fixed on the frame, the angle of swing itself is variable, by loosening the mounting of the compressed air cylinder 34 and moving it toward or away from the extension 32.

At the end of the swinging of the thread pulling lever 25, the vacuum generator 42 is activated. For this purpose, as shown in FIG. 3, compressed air is fed into the ejector nozzle 43 via the 3/2-way valve 46. That compressed air, as is known, entrains surrounding air with it so that a considerable suction effect is produced in the suction tube 37 connected to the ejector nozzle 43.

In the case of the transvector nozzle 44 shown in FIG. 4, compressed air is fed into an annular slot 49, for instance via a roller-actuatable 3/2-way valve 47 controlled by a cam slot 47'. In this way, a vacuum is produced in the slot 49, with the result that surrounding air flows into the transvector nozzle 44. In this way, a suction is also produced in the suction tube 37 connected to the transvector nozzle 44.

With the above-mentioned activating of the vacuum generator 42 and at the time when the fabric support plate 48 is again in its initial starting position, the looper thread 5 is cut by the thread-cutting device 6 close to the end of the buttonhole 8, the cutting device 6 being, as is known, arranged above the fabric support plate 48, as shown in FIGS. 1 and 2. The looper-thread end 18, which hangs out of the needle hole 16 and is guided by the slot 17, is pulled by the suction into the opening 38 of the suction tube 37 (see FIG. 2). Before this, the thread puller 20 has, by means of its thread pulling lever 25, pulled a sufficient amount of looper thread 5 out of the thread tensioning device 15 so that, after the cutting of the looper thread 5, the end 18 of the looper thread 5 can be dependably drawn into the suction tube opening 38.

Then, during the idle time of the eyelet buttonhole sewing machine 1, between the end of the sewing operation which just has been effected and the start of the following sewing operation, the vacuum generator 42 is again placed in its inactive condition, as a result of which the suction is eliminated in the suction tube 37. However, since a sufficient amount of thread has been pulled forward by the thread puller 20, the looper-thread end 18 cannot escape from the opening 38 of the suction tube 37.

With the start of the following sewing process, namely upon the known idle stroke of the fabric support plate 48, the vacuum generator 42 is again activated. By the suction which is now built up again in the suction tube 37, the end 18 of the looper thread is pulled taut. In this way the looper thread end 18 is held in position for being dependably oversewn by the sewing stitches for the formation of the right hand welt 9 of the buttonhole 8 which is thus produced. After the looper-thread end 18 has been fixed in position by the first sewing stitches, the vacuum generator 42 can again be switched into its inactive condition since the looper-thread end 18, which is sufficiently fixed in place, is now completely covered by the right hand welt 9 even without suction in the suction tube 37.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. In a looper-thread feed device for feeding a looper thread in an eyelet buttonhole sewing machine, the sewing machine comprising a turnable looper pedestal, a thread cutting device for cutting the looper thread, and a buttonhole cutting device; a throat plate and a thread tensioning device which tensions the looper thread being provided on the looper pedestal; the improvement comprising a suction device for engaging and securing a cut end of the looper thread, vacuum coupling means for functionally connecting the suction device with a vacuum generator, and thread pulling means for pulling the looper thread to a position where an end thereof can engage the suction device.

2. A looper-thread feed device according to claim 1, wherein the suction device is provided between the buttonhole cutting device and the throat plate and includes a suction tube which is in communication with said vacuum coupling means.

3. A looper-thread feed device according to claim 2, wherein the vacuum generator includes an ejector nozzle connected to the suction device via the vacuum coupling means.

4. A looper-thread feed device according to claim 2, wherein the vacuum generator includes a transvector nozzle which is connected to the suction device via the vacuum coupling means.

5. A looper-thread feed device according to any one of claims 1, 3, and 4, wherein the vacuum generator is connected to an external source of compressed air via an electromagnetically actuatable 3/2-way valve.

6. A looper-thread feed device according to any one of claims 1, 3 and 4, wherein the vacuum generator is connected to the external source of compressed air via a roller-actuatable 3/2-way valve which is controlled by cam means.

7. A looper-thread feed device according to claim 1, wherein the thread pulling means comprises a support bar rigidly secured to the looper pedestal and a thread pulling lever which is swingable around a pivot on the support bar, the thread pulling lever having an inactive position wherein a thread guide hole on the thread pulling lever for guiding said looper thread is aligned with lower guide means on the looper pedestal for guiding the looper thread.

8. A looper-thread feed device according to claim 7, wherein the inactive position of the thread pulling lever is defined by a position of a stop on said support bar.

9. A looper-thread feed device according to claim 8, further comprising spring means for urging said thread pulling lever into said inactive position.

10. A looper-thread feed device according to claim 7, wherein said thread pulling lever further has an active position and said thread pulling lever moves toward said active position while pulling the looper thread toward the suction device.

11. A looper-thread feed device according to claim 7, further comprising a piston rod on a compressed air cylinder which is disposed on the sewing machine for pressing momentarily against an extension on the thread pulling lever, as a result of which the thread pulling lever carries out a swinging movement through an angle from its inactive position to its active position.

12. A looper-thread feed device according to claim 11, further comprising means for adjusting the angle of the swinging movement.

* * * * *